United States Patent [19]

Audeh

[11] Patent Number: 4,640,692

[45] Date of Patent: Feb. 3, 1987

[54] PROCESS FOR THE ELIMINATION OF PYRITE

[75] Inventor: Costandi A. Audeh, Princeton, N.J.

[73] Assignee: Mobil Oil Corporation, New York, N.Y.

[21] Appl. No.: 759,386

[22] Filed: Jul. 26, 1985

[51] Int. Cl.[4] ..... C10L 00/00; C10B 57/00; C09C 1/56; C01B 31/02

[52] U.S. Cl. ..... 44/1 SR; 201/17; 423/460; 423/461; 75/6

[58] Field of Search ..... 44/1 SR; 201/17; 423/460, 461; 75/6

[56] References Cited

U.S. PATENT DOCUMENTS

| | | | |
|---|---|---|---|
| 3,756,791 | 9/1973 | Moncke | 44/1 SR |
| 3,768,988 | 10/1973 | Meyers | 44/1 R |
| 3,779,722 | 12/1973 | Tatum | 44/1 SR |
| 3,824,084 | 7/1974 | Dillon et al. | 44/1 R |
| 3,909,213 | 9/1975 | Sanders | 44/1 SR |
| 4,022,588 | 5/1977 | Dessau | 44/15 R |
| 4,155,717 | 5/1979 | Sun et al. | 44/1 R |
| 4,233,034 | 11/1980 | Miller et al. | 44/1 SR |

*Primary Examiner*—Andrew H. Metz
*Assistant Examiner*—William G. Wright
*Attorney, Agent, or Firm*—Alexander J. McKillop; Michael G. Gilman; Charles J. Speciale

[57] ABSTRACT

A process for the removal of pyritic sulfur from shale, coal and other carbonaceous material which comprises reacting a pyritic containing solid with a acidic cerium IV salt solution.

13 Claims, 1 Drawing Figure

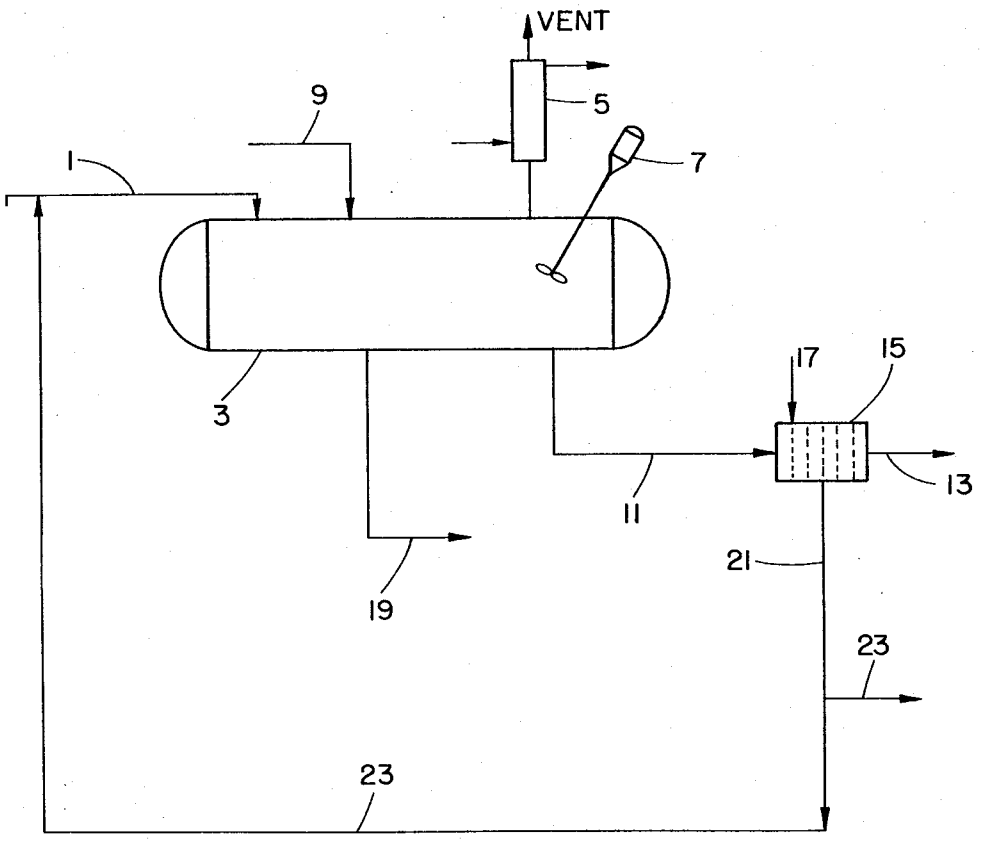
VENT
5
7
9
1
3
11
15
17
13
21
23
19
23

PROCESS FOR THE ELIMINATION OF PYRITE

BACKGROUND OF THE INVENTION

1. Field of the Invention

The present invention relates to a process for the elimination of pyrite in coal, shale and other carbonaceous material. The elimination of pyritic sulfur by the present method avoids the undesirable by products when pyrite containing solids are burned.

2. Discussion of the Prior Art

Coal is an important fuel, and large amounts are burned in thermal generating plants primarily for the production of electrical energy. One of the principal drawbacks in the use of coal as a fuel is that many coals contain amounts of sulfur which generate unacceptable amounts of sulfur oxides upon burning. For example, coal combustion is by far the largest single source of sulfur dioxide pollution in the United States at present and currently accounts for 60 to 65% of total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites. The organic sulfur is chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coal as well as Western and Midwestern coals are known to be rich in pyritic and organic sulfur.

Oil-shale deposits in the United States occur over a wide area with the most extensive deposits in the Devonian-Mississippian shales of the Eastern United States. Additional deposits are present in the Green River formation of Colorado, Utah and Wyoming. These vast deposits offer an important potential reserve of hydrocarbons in the face of the eventual depletion of the conventional sources of oil. Various methods, such as for example, retorting and pyrolsis are used to win oil from shale. Various techniques are used commercially as illustrated in Kirk-Othmer, Vol. 16, pp 333–352 (John Wiley and Sons, New York). However, air pollution in the form of gases containing oxides of sulfur, nitrogen oxides, carbon monoxides and trace hydrocarbons remains an important problem. Additionally, retorting, refining and electric power generation contribute to the pollution problem when coal, shale or other carbonaceous material that contains substantial amounts of pyrite are used as sources of fuel in these processes. Thus, a mechanism to remove pyritic sulfur prior to combustion or retorting of shale is important before effective utilization of these fuels can be exploited.

Heretofore, it was recognized that it would be highly desirable to eliminate (or substantially eliminate) the sulfur content of coal or other carbonaceous materials prior to combustion. In this regard, a number of processes have been suggested in reducing inorganic (pyritic) portion of the sulfur in coal, shale and other carbonaceous materials.

For example, it is known that at least some pyritic sulfur can be physically removed from coal by grinding the coal, and subjecting the ground coal to froth floatation or washing processes. While such processes can desirably remove pyritic sulfur and ash from the coal, these processes are not fully satisfactory because a significant portion of the pyritic sulfur is not removed. Attempts to increase the portion of pyritic sulfur removed have not been successful because the processes are not sufficiently selective and often can result in a large portion of coal being discarded along with ash and pyrite.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal which involves exposing coal particles to a solution of ferric chloride. The patent suggests that in this process ferric chloride reacts with pyritic sulfur to provide free sulfur according to the following reaction process:

$$2FeCl_3+FeS_2 \rightarrow 3FeCl_2+S$$

While this process is interesting because it describes a method of removing pyritic sulfur, its principal disadvantage is that liberated solid sulfur must be separated from the coal solids. The solid sulfur is liberated by different methods such as froth flotation, vaporization and solvent extraction. All of these procedures, however, inherently add a second discrete process step with its attendent problems.

In another approach, U.S. Pat. No. 3,824,084 to Dillon, issued July 16, 1974, discloses a process involving grinding coal containing pyritic sulfur in the presence of water to form a slurry, and then heating the slurry under pressure in the presence of oxygen and sulfuric acid. The patent disloses that under these conditions the pyritic sulfur (for example, $FeS_2$) can react to form sulfuric acid, ferrous sulfate and ferric sulfate. The patent discloses that typical reaction equations for the process at the conditions specified are as follows:

$$FeS_2+H_2O+7/2O_2 \rightarrow FeSO_4+H_2SO_4$$

$$2FeSO_4+H_2SO_4+1/2O_2 \rightarrow Fe_2(SO_4)_3+H_2O$$

Numerous other methods have been proposed for reducing the pyritic sulfur content of coal and other carbonaceous material. For example, U.S. Pat. No. 4,155,717 to Sun, et al., discloses a process for reducing sulfur content of coal by treating coal particles with an aqueous solution of alkali metal and alkaline earth metal sulfites and bisulfites. Further, U.S. Pat. No. 4,233,034 to Miller, et al., discloses a process to reduce the amount of pyritic and organic sulfur in coal, shale and other carbonaceous materials by contacting these materials with hydrogen, transition metal salts and a buffer under elevated temperature and pressure.

While the art has provided a number of processes for the reduction of pyritic sulfur content of coal, shale and other carbonaceous materials, there still exists a need for methods to more effectively reduce the sulfur content of coal and other carbonaceous material.

Accordingly, it is one object of the present invention to provide a process for the elimination of pyrite in coal, shale and other carbonaceous materials.

It is another object of this invention to provide a method for the elimination or at least the substantial reduction of sulfur dioxide from the coal combustion products of coal, shale or other carbonaceous materials.

The achievement of these and other objects will be apparent from the following description of the subject invention.

SUMMARY OF THE INVENTION

These and other objects are achieved by reacting an acidic solution of cerium IV salt with a pyrite containing solid. Briefly, this invention relates to a novel process for the removal of pyritic sulfur in carbonaceous materials.

In particular, this relates to a process for the removal of pyritic sulfur from a pyrite containing solid comprising:

(a) reacting a first quantity of an acidic solution of cerium IV salt with a pyrite containing solid, wherein the molar ratio of the cerium IV salt to pyrite is less than stoichiometric requirement to remove all of the pyrite from the solid, (b) separating said cerium IV salt-treated pyrite containing solid from the said reaction mixture; and (c) reacting the remaining pyrite containing solid with a second quantity of acidic solution of cerium IV salt, wherein the molar ratio of the cerium IV salt to pyrite is more than the stoichiometric requirement to remove the remaining pyrite from the solid.

BRIEF DESCRIPTION OF THE INVENTION

FIG. 1 is a schematic view of one system for carrying out the process of the present invention.

DETAILED DESCRIPTION OF THE INVENTION

The novel process of the present invention can eliminate or substantially eliminate the pyritic sulfur content of coal, shale and other carbonaceous materials by treatment with an acidic solution of cerium IV sulfate. Further, the elimination of pyritic sulfur in coal, shale or other carbonaceous materials provides a means of eliminating sulfur dioxide and other gases when these materials are combusted.

In accordance with present invention, since cerium IV in acid solution has a higher oxidation potential than other aqueous oxidants it is a stronger oxidant when used for the removal of pyritic sulfur than other aqueous oxidants. This is illustrated by the following equations:

$$\text{Ce IV} + e \rightarrow \text{Ce III} \quad 1.61\ E^{\circ}(v)$$

$$\text{Fe III} + e \rightarrow \text{Fe II} \quad 0.77\ E^{\circ}(v)$$

The higher oxidation potential enables the complete elimination of pyritic sulfur in coal, shale or other carbonaceous materials through the reaction between the pyrite and the cerium IV salt.

It will be understood that the present invention is broadly applicable to the treatment of various types of coal, shale and other carbonaceous materials. In particular, the process is directed to shale kerogen. It will also be understood that the present invention is not limited to the treatment of any specific type of coal, shale or other carbonaceous materials but it is also to be noted that the pyritic sulfur content of coals, shale and other carbonaneous materials may vary greatly even in one particular field and that all types of pyritic sulfur containing carbonaceous materials may be treated according to the process of this invention.

The particle size of coal, shale, or other carbonaceous materials treated in accordance with the present invention can vary over wide ranges. In general, the particles should be of a size to promote the removal of pyritic sulfur upon contacting the acidic solution. For instance, the coal, shale, or other carbonaceous material may have an average particle size of one-eighth inch in diameter, or in some instances, as small as minus 400 mesh (Tyler screen) or smaller. Depending on the occurrence and mode of distribution of pyritic sulfur in coal, shale, or other carbonaceous material, the rate of sulfur removal will vary. In general, if the pyritic particles are liberated readily upon grinding, the sulfur removal rate will be faster. If the pyritic particles are small and associated with the coal or shale through surface contact or encapsulation, then the degree of grinding will have to be increased in order to provide for the liberation of the pyrite particles. The coal particles must be reduced in size to effectively mix with the aqueous medium. A very desirable particle size is often minus 24 mesh, or even minus 48 mesh. For coals or shales having fine pyrite distributed through the coal or shale matrix, particle size distribution wherein from about 50 percent to about 85 percent, preferably from about 60 percent to about 70 percent, by weight of the particles pass through minus 200 mesh provides a preferred feed wherein the maximum sizes are minus 24 or even minus 48 mesh.

The coal, shale or other carbonaceous particles employed in this invention can be provided by a variety of known processes, for example, grinding or crushing.

Elevated temperatures can be desirably employed to accelerate the removal of pyritic sulfur from coal and shale in the process. For example, temperatures from about 100° C. to about 150° C., preferably from about 100° C. to about 125° C., and more preferably from about 105° C. to about 110° C., can be employed. Under these reaction conditions, a substantial portion of the pyritic sulfur in coal and shale can be rapidly removed without significant adverse effects on the coal, shale or other carbonaceous substrate.

It is desirable to employ elevated pressures to accelerate the process of the present invention. It is contemplated that the present invention may be conducted at any pressure which is not counter-productive to the process.

The acidic solution used to remove pyritic sulfur coal, shale and other carbonaceous materials in accordance with this invention is a solution containing cerium IV salt and an acid. Cerium IV salt in acid solution has a higher oxidation potential than other aqueous oxidants which enables this solution to be effective for the removal of pyritic sulfur from coal, shale and other carbonaceous materials.

Cerium salts which have been found effective in the present invention include cerium sulfate, cerium ammonium sulfate and cerium nitrate. Cerium sulfate is preferred since it has the highest oxidation potential of these salts.

It is also preferable that the aqueous treating solution be acidic in character, and thus it is desirable to include in the treating solution a moderate amount of acid. Any acid which does not adversely affect the organic matter of the carbonaceous material being treated can be used. Sulfuric acid is preferred because it does not attack the organic species or change the character of the carbonaceous material. The acid used should have a concentration in the range of about 0.01–10N.

Although, a single treatment of a pyrite-containing solid with an appropriate quantity of an acidic solution of cerium IV salt will effect a measurable reduction in the pyrite content of the solid, for complete elimination of pyrite it is preferable to practice the process of the present invention in multiple stages. Thus, a two stage operation is quite effective although 3, 4, 5 or more stages are often more beneficial to achieve the desired reduction in pyrite content. In the first stage of a two stage process and in the first and intermediate stages of those processes employing more than two stages, these stages are operated in a fashion distinct from that of the last stage insofar as the relative quantities of the cerium IV salt solution are concerned. Thus, in the initial and any intermediate stages, the ratio of the cerium IV salt to pyritic sulfur of the carbonaceous material should always be less than stoichiometric. While in the last treating step, the ratio should always be greater than stoichiometric. Those skilled in the art will appreciate that the number of stages utilized when practicing the present invention should be determined by carrying out a series of screening treatments to provide sufficient data to determine the ideal number of stages to be employed so as to achieve the desired pyrite reduction of a given material.

In the initial treating step, the molar ratio of cerium IV salt to the pyrite in the carbonaceous material is always less than stoichiometric requirement to remove all of the pyrite from the carbonaceous material. The molar ratio of cerium IV salt to the pyrite is about 0.1 to about 0.8. The preferred molar ratio of cerium IV salt to pyrite in the carbonaceous material is about 0.3 to about 0.5. The normality of acid to be about 0.1 to about 2.0, with the preferred normality of about 0.8 to about 1.2.

The molar ratio of cerium IV salt in the last treating step to the pyrite in the carbonaceous material is always more than stoichiometric. The molar ratio of cerium IV salt to the quantity of pyrite is about 1.1 to about 10. The preferred molar ratio of cerium IV salt to pyrite in the carbonaceous material is about 7 to about 9. The normality of acid to be about 0.1 to about 2.0, with the preferred ratio being about 0.8 to about 1.2.

The amount of cerium IV salt will vary depending on the type of carbonaceous material to be treated in accordance with the present invention. Since the pyritic sulfur content of coal, shale or other carbonaceous materials vary widely even in one field, the process of this invention is adaptable by following the principle that the molar ratio of cerium IV salt to pyrite in the carbonaceous material should be less than stoichiometric in any step except the final step in any multiple treating process conducted in accordance with the subject invention. Preferably the ratio in any initial or intermediate stage should be about 0.3 to about 0.8 of the stoichiometric requirement. In the final step, the molar ratio of cerium IV salt to pyrite in the carbonaceous material should exceed the stoichiometric requirement to remove the remaining pyrite from the carbonaceous material. Preferably the ratio in any final stage should be about 1.1 to about 10 of the stoichiometric requirement.

In order to cause significant separation of pyritic sulfur from the organic matrix of coal, shale or other carbonaceous material, the carbonaceous material which has been contacted with the treating solution should be agitated. Agitation is accomplished in the present invention with the carbonaceous material being an aqueous slurry. The agitation is most easily accomplished by mechanical mixing although any other known technique, such as for example, an ultrasonic mixer, can be used. The agitation procedure can be accomplished simultaneously with the treating procedure, in which case the aqueous slurry is composed of particulate coal, shale or other carbonaceous material and the treating solution of the present invention.

The contact time of the treating solution with the coal, shale or carbonaceous material necessary for the elimination or substantial elimination of pyritic sulfur varies depending on a number of factors, such as for example, the concentration of the treating solution, the degree of agitation and the type of carbonaceous material being processed. Normally, contact times on the order of about 15 minutes to about 24 hours are employed for the entire process, with a contact time of about 30 minutes to about 3 hours per stage of the process being suitable in many instances. A contact time of about 1 hour per stage of the process is preferred.

After contacting the pyritic sulfur containing coal, shale or other carbonaceous material with the aqueous treating solution and heating the mixture to reflux temperature, the elemental sulfur becomes separated from the aqueous treating solution by reflux wherein the sulfur is deposited on the condenser.

The process of the present invention is intended to be adaptable, so that pyrite sulfur will be eliminated or substantially eliminated when any carbonaceous material is subjected to the process. For example, if a particular carbonaceous material has higher concentration of pyritic sulfur or has properties that render it resistant to the process, the elimination or substantial reduction of pyritic sulfur is accomplished by repeating the process until the pyritic sulfur is removed or substantially eliminated.

In order to illustrate the preferred embodiment of the present invention in which coal, shale or other carbonaceous material is treated to remove pyritic sulfur, FIG. 1 is presented. In accordance with the system shown is this figure, particulate coal, shale or other carbonaceous material is fed into heated vessel 3 via inlet line 1. Heated vessel is equipped with a heating means (not shown), reflux condenser 5 and mixer 7. In vessel 3, the particulate coal, shale or other carbonaceous material is mixed with a treating solution of acidic cerium IV salt, which enters via supply line 9. The aqueous mixture of particulate coal, shale or other carbonaceous material and treating solution is heated to reflux temperature in vessel 3 to effect reduction of pyrite. Upon deposition of elemental sulfur on the upper surface of reflux condenser 5, the aqueous solution is allowed to cool and is discharged via exit line 11 and filtered in filter bed 15. The retained solids are washed with water fed by supply line 17. The wash solution is discharged from filter bed 15 by exit line 13. The residual solids are transported via transit line 21 to vessel 3 where an addional quantity of treating solution is added to vessel 3 via line 9. This process is repeated until the final treatment where the molar ratio of cerium IV salt in the treating solution to pyritic sulfur exceeds the stoichiometric requirement. Upon completion of final treatment the pyrite deficient substance is discharged via exit line 23 to a drying means, such as a rotary kiln (not shown), where excess water is removed from the treated coal, shale or carbonaceous material.

The following examples are presented as specific embodiments of the present invention and show some of the unique characteristics of the instant process and are not to be considered as constituting a limitation on the present invention.

EXAMPLE 1

Step 1: 18.6 gms of an eastern shale kerogen containing 24% pyrite was mixed with 250 ml of a solution containing 9 gms of cerium IV sulfate and 12 gms of sulfuric acid. The mixture was then heated to its reflux temperature until the deposition of elemental sulfur on the inner surface of the reflux condenser stopped. Heating was then stopped.

Step 2: After the solution was cooled to room temperature, it was filtered, and the solid recovered by the filtration was washed with deionized water. The solid was then dried in a vacuum oven, and its pyrite content determined. The pyrite content of the dry sample was 18%.

Step 3: The dry sample was then mixed with 300 ml of water and made into a slurry in an ultrasonic mixer. The slurry was then filtered. The solid recovered by filtration was mixed with 250 ml of a solution containing 7 gms of cerium IV sulfate and 12 gms of sulfuric acid. This mixture was then heated to its reflux temperature until elemental sulfur began depositing on the inner surface of the reflux condenser.

Step 4: After the solution was cooled to room temperature, it was filtered, and the solid recovered by filtration was washed well with deionized water. The solid was then dried in a vacuum oven, and its pyrite content determined. The pyrite content of the dry sample was 12%.

Step 5: The dry sample was then mixed with 300 ml of water and made into a slurry in an ultrasonic mixer. The slurry was then filtered. The solid recovered by filtration was mixed with 250 ml of a solution containing 4.5 gms of cerium IV sulfate and 12 gms of sulfuric acid. The mixture was then heated to its reflux temperature until elemental sulfur began depositing on the inner surface of the reflux condenser.

Step 6: After the solution was cooled to room temperature, it was filtered, and the solid recovered by filtration was washed with deionized water. The solid was then dried in a vacuum oven, and its pyrite content determined. The pyrite content of the dry sample was 9%.

Step 7: The dry sample was then mixed 300 ml of water and made into a slurry in an ultrasonic mixer. The slurry was then filtered. The solid recovered by filtration was mixed with 250 ml of a solution containing 3.5 gms of cerium IV sulfate and 12 gms of sulfuric acid. The mixture was then heated to its reflux temperature until elemental sulfur began depositing on the inner surface of the reflux condenser.

Step 8: After the solution was cooled to room temperature, it was filtered, and the solid recovered by filtration was washed with deionized water. The solid recovered by filtration was dried in a vacuum oven, and its pyrite content determined. The pyrite content of the dry sample was 5%.

Step 9: The dry sample was then mixed with 300 ml of water and made into a slurry in an ultrasonic mixer. The slurry was then filtered. The solid recovered by filtration was mixed with 250 ml of a solution containing 10 gms of cerium IV sulfate and 12 gms of sulfuric acid. The mixture was then heated to its reflux temperature until elemental sulfur began depositing on the inner surface of the reflux condenser.

Step 10: After the solution was cooled to room temperature, it was filtered, and the washed solid recovered. The solid recovered by filtration was dried in a vacuum over and its pyrite content determined. The dry sample did not contain pyrite and was composed of 97.2% kerogen and 2.8% $TiO_2$ in the form of rutile and anatase.

EXAMPLES 2

The following example was conducted in accordance with the method of Example 1, except for the quantities used.

EXAMPLE 3

This example demonstrates that the procedure described in this instant is superior to pyrite removal by the known art using an acid solution containing Fe III. 13.3 g of iron III sulfate which is about twice the stoichiometric amount needed were used to treat 2 g of pyrite containing carbonaceous material used in example 1, in one step. After applying Step 2 of Example 1 the pyrite content was determined. This was found to be 11%, which is about a 46% reduction.

| Cerium Treatment Steps | Grams of Carbonaceous Material | % wt of Pyrite | Grams of Cerium IV Sulfate | Grams of Sulfuric Acid | % Pyrite of Dry Sample |
|---|---|---|---|---|---|
| (1) | 20 | 36 | 14 | 12 | 27 |
| (2) | 18 | 27 | 10 | 12 | 18 |
| (3) | 16 | 18 | 7 | 12 | 12 |
| (4) | 15 | 12 | 5 | 12 | 9 |
| (5) | 13 | 9 | 4 | 12 | 4 |
| (6) | 11 | 4 | 8 | 12 | 0 |
| Final Product | 10 | 0 | — | — | — |

Obviously, other modifications and variations of the present invention are possible in the light of the above teachings. It is therefore, to be understood that changes may be made in the particular embodiments of this invention which are within the full intended scope of the invention as defined by the appended claims.

What is claimed is:

1. A process for the removal of pyritic sulfur from a pyritic containing solid comprising:

(a) reacting a first quantity of an acidic solution of cerium IV salt with a pyrite containing solid, wherein the molar ratio of the cerium IV salt to pyrite is less than the stoichiometric requirement to remove all of the pyrite from the solid;

(b) separating said cerium IV treated pyrite containing solid from the reaction mixture; and (c) reacting the remaining pyrite-containing solid with a second quantity of an acidic solution of cerium IV salt, wherein the molar ratio is more than the stoichiometric to remove the remaining pyrite from the solid.

2. A process as defined in claim 1, where the pyrite containing solid is a carbonaceous material.

3. A process as defined in claim 1, wherein the pyrite containing solid is coal.

4. A process as defined in claim 1, wherein the pyritic containing solid is shale.

5. A process as defined in claim 1, wherein said cerium IV salt is cerium IV sulfate.

6. A process as defined in claim 1, wherein said solution of cerium IV salt is acidified with sulfuric acid.

7. A process as defined in claim 1, where in steps (a) and (c), the acidic solution of cerium IV salt and the pyritic containing solid are thoroughly mixed.

8. A process as defined in claim 1, wherein in steps (a) and (c) the reactant mixture is heated to reflux temperature.

9. A process as defined in claim 1, wherein following step (b), steps (a) and (b) are repeated.

10. A process as defined in claim 1, wherein the amount of acidic solution of cerium IV salt in step (a) is in the range of about 0.1 to about 0.8, times the stoichiometric amount of pyrite in the solid.

11. A process as defined in claim 1, wherein the amount of acidic solution of cerium IV salt in step (c) is in the range of about 1.1 to about 10, times the stoichiometric amount of pyrite in the solid.

12. A process as defined in claim 10, wherein the acidic solution in steps (a) and (c) is sulfuric acid and has a concentration in the range of about 0.01 to about 10 normal.

13. A process as defined in claim 8, wherein the temperature in steps (a) and (c) is about 100° C. to about 150° C.

* * * * *